US006299040B1

(12) United States Patent
Matias

(10) Patent No.: US 6,299,040 B1
(45) Date of Patent: Oct. 9, 2001

(54) TEAR-AWAY RETAINING LANYARD

(75) Inventor: John Matias, Binghamton, NY (US)

(73) Assignee: Buckingham Manufacturing Co., Inc., Binghamton, NY (US)

( * ) Notice: Subject to any disclaimer, the term of this patent is extended or adjusted under 35 U.S.C. 154(b) by 0 days.

(21) Appl. No.: 09/346,849

(22) Filed: Jul. 2, 1999

(51) Int. Cl.[7] ..... A45F 3/14
(52) U.S. Cl. ..... 224/254
(58) Field of Search ..... 224/5 A, 218, 224/254, 220, 605; 182/3, 5; 248/500

(56) References Cited

U.S. PATENT DOCUMENTS

| | | | | |
|---|---|---|---|---|
| 2,947,456 | * | 8/1960 | Seron | 224/258 |
| 3,163,436 | * | 12/1964 | Shride et al. | 280/822 |
| 3,317,098 | * | 5/1967 | Auraen | 224/609 |
| 3,530,547 | * | 9/1970 | Robinson | 403/182 |
| 3,595,501 | * | 7/1971 | Stencel | 244/142 |
| 3,670,444 | * | 6/1972 | Dieterich | 43/12 |
| 3,908,875 | * | 9/1975 | Wilson et al. | 224/5 A |
| 4,253,544 | * | 3/1981 | Dalmaso | 182/3 |
| 4,315,641 | * | 2/1982 | Larsen | 280/822 |
| 4,487,102 | * | 12/1984 | Fritz | 89/1.55 |
| 4,728,123 | * | 3/1988 | Kassal et al. | 224/220 X |
| 4,937,920 | * | 7/1990 | Tsai | 24/3.3 |
| 5,052,602 | * | 10/1991 | Duchi, Jr. et al. | 224/218 |
| 5,082,156 | * | 1/1992 | Braun | 224/220 |
| 5,083,522 | * | 1/1992 | Ashrow | 114/215 |
| 5,090,503 | * | 2/1992 | Bell | 182/5 |
| 5,588,687 | * | 12/1996 | Pinkerton | 292/259 R |
| 5,738,328 | * | 4/1998 | O'Farrill | 248/500 |
| 5,983,760 | * | 11/1999 | Clarke | 81/436 |

OTHER PUBLICATIONS

Snap & Snap Chain Saw Lanyard, from a catalog by American Arborist Suppliers, Inc., Catalog No. S190196–00.

* cited by examiner

*Primary Examiner*—Allan N. Shoap
*Assistant Examiner*—Joseph C. Merck
(74) *Attorney, Agent, or Firm*—Salzman & Levy

(57) ABSTRACT

A retaining device is disclosed for attaching a chainsaw to a worker, working aloft. The retaining device provides a tear-away component between two sections of a lanyard. When the chainsaw is pinched in a falling limb, the slow, tearing motion of the tear-away component results in a minimal amount of impact force being exerted on a worker. In the event the tear-away component pulls apart entirely, the chainsaw is released from the worker and falls to the ground with the limb. The worker maintains his/her position within the structure. Alternatively, if the chainsaw is dropped by the worker, it will fall below the feet of the worker, allowing him/her to retrieve the chainsaw. A bystander below will not be hit by the falling chainsaw.

17 Claims, 4 Drawing Sheets

TEAR-AWAY RETAINING LANYARD

FIELD OF THE INVENTION

The present invention relates to equipment used by a worker climbing aloft, and, more particularly, to a retaining lanyard that attaches a chainsaw to a worker, the lanyard tearing away from the worker if the chainsaw is pinched in a falling limb. The bungee design reduces the working length, which decreases the potential of entanglement when working aloft.

BACKGROUND OF THE INVENTION

In many instances, workers are required to climb trees, utility poles, or other vertical structures. For example, utility workers are frequently called upon to remove fallen limbs and trim trees away from power lines. Similarly, tree surgeons shape trees and cut dead limbs. These jobs often require the use of a gas-powered chainsaw or other tool and are commonly performed while a worker is working aloft.

Climbing and remaining stationary on a structure with a chainsaw is a difficult task. Numerous retaining devices have been developed to prevent a worker from accidentally dropping the chainsaw. These devices keep the chainsaw attached to the worker while allowing the worker to perform a job with unencumbered use of the chainsaw. Further, if the chainsaw accidentally falls, these devices allow the saw to reach a level below the worker's feet, but above the ground. Thus, the risk of damage to the chainsaw or injury to a bystander on the ground is minimized.

Many of the aforementioned retaining devices are lanyards or cords that incorporate a break-away component (e.g., swage) into their designs. One such device, entitled SNAP & SNAP CHAIN SAW LANYARD, is illustrated in a catalog by American Arborist Suppliers, Inc., as Catalog No. S190196-00. The devices comprise break-away or tear-away components that separate in response to a predetermined force. For example, when a chainsaw is dropped, an impact load (i.e., the weight of the falling chainsaw) acts on the component. Tensile forces are exerted on the component, causing it to shear or break. In order for this shearing action to occur, the tensile forces obviously must be greater than the predetermined failure point of the component. Unfortunately, the force exerted on a worker during the shearing of the component could be sufficient to dislodge the worker or cause severe injury while the worker is attached to the structure. Currently, chainsaw lanyards separate when sufficient force is applied to shear the break-away feature.

What is needed is a retaining lanyard that enables the chainsaw to tear away slowly while minimizing the force on the worker. In other words, a break-away mechanism is needed to provide a controlled tearing action over a predetermined distance when the chain saw is pinched in a falling limb.

The present invention provides such a device for use by a worker. It includes a tear-away component and a feature which minimizes the lanyard length when relaxed. The tear-away component is housed in a nylon sheath to protect the component from damage. The tear-away component is designed to separate with a force that, in general, can be withstood by the human body without a loss of balance. The novel device maintains attachment of a chainsaw to the worker and allows freedom of movement when cutting. There are numerous methods of attaching/detaching the chainsaw between a worker's fall protection belt and the novel tear-away retaining lanyard.

The lanyard construction consists of a nylon or polyester tubular web with an elastic cord center, capable of reducing its fully stretched length by one half. This feature aids in reducing the potential of entanglement when working aloft.

If the chainsaw gets caught in a falling limb while the worker is attached to the tree, the tear-away component will pull apart when an excessive force is applied. In the event that the tear-away component separates entirely, the chainsaw will be released from the worker and fall to the ground with the limb, allowing the worker to maintain his/her position within the structure.

SUMMARY OF THE INVENTION

In accordance with the present invention, there is provided a chainsaw retaining device comprising a tear-away component. The tear-away component is designed to separate if an excessive force (e.g., a chainsaw being pulled by a falling limb) is applied thereto. The tear-away component is located between two discrete lanyard portions of the device. One of the lanyard portions includes an elastic cord that minimizes the overall length of the lanyard and reduces the potential of the lanyard getting caught in tree branches, limbs, etc. While the retaining device of this invention connects a chainsaw to a worker, other mechanical devices can also be attached to a worker with the inventive device.

By the use of the inventive tear-away lanyards, a chainsaw can accidentally fall out of a worker's hands without pulling the worker down along with it. The chainsaw falls to a level below the worker's feet, where it can easily be recovered. Moreover, the chainsaw will not fall to the ground, thereby minimizing the potential for damage to equipment or injury to persons below.

It is an object of the invention to provide a lanyard for attaching a chainsaw to a worker.

It is another object of the invention to provide a strong, elastic component to minimize the lanyard length while being used or stowed on a tree belt, thereby reducing the potential of the lanyard being caught on objects.

It is another object of the invention to provide an elastic component that enables a worker to reach or cut overhead.

It is still another object of the invention to provide a tear-away component that slowly separates when a force, exceeding its tolerance, is applied thereto.

It is still another object of the invention to provide a mechanism for easy product attachment/detachment which affords a worker a quick method to attach or separate him/herself from a chainsaw.

It is yet another object of the invention to minimize the force on a worker when the chainsaw is falling as a result of being pinched in a falling limb.

It is another object of the invention to allow a worker freedom to move when cutting with a chainsaw.

It is yet another object of the invention to keep a chainsaw attached to a worker at a level below his/her feet if the chainsaw falls out of the worker's hands.

BRIEF DESCRIPTION OF THE DRAWINGS

A complete understanding of the present invention may be obtained by reference to the accompanying drawings, when considered in conjunction with the subsequent detailed description, in which.

For purposes of brevity and clarity, like elements and components will bear the same number and designation throughout the figures.

DESCRIPTION OF THE PREFERRED EMBODIMENT

Generally speaking, the invention comprises a retaining device for attaching a chainsaw to a worker. One end of the device is attached to the worker, the other end to a chainsaw. The device slowly tears away from the worker when pinched or caught by a falling limb, eliminating the potential to cause injury to the worker. Nevertheless, during normal operation, while working aloft, the worker can easily maneuver the chainsaw without the device getting tangled on the worker, other limbs, or debris.

Figure 1:
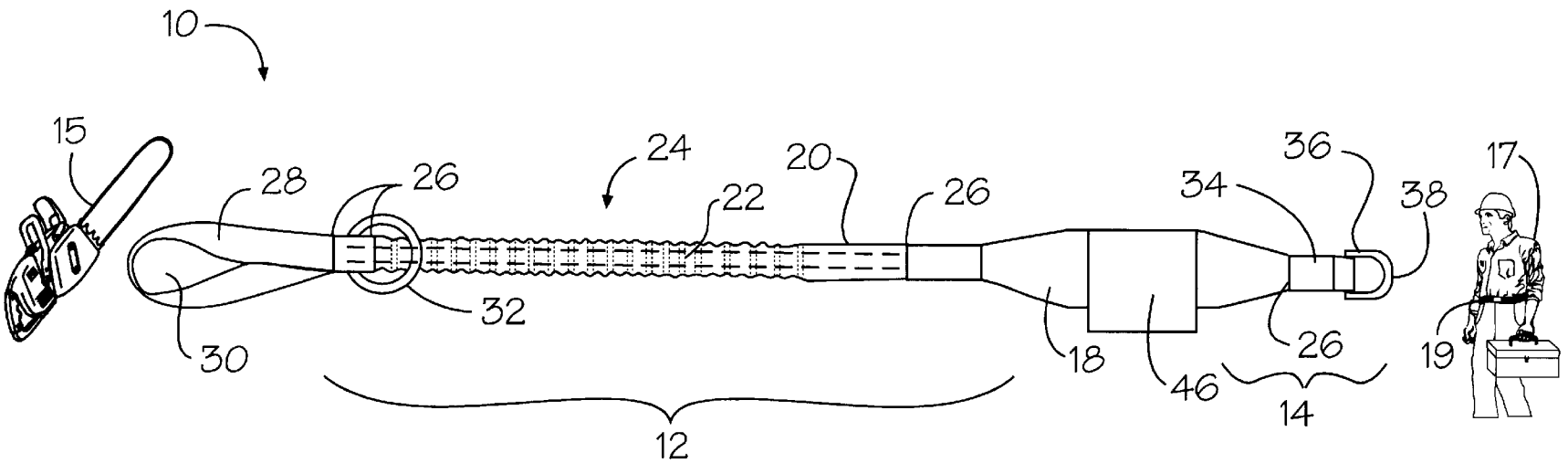
FIG. 1 illustrates the tear-away retaining lanyard in accordance with the present invention.

Referring now to FIG. 1, shown is the tear-away retaining device 10 of the present invention. The device 10 consists of two major, separate sections 12 and 14. Section 12 connects directly to a chainsaw 15 or other tool or device, which may or may not be powered. A worker 17 attaches section 14 to his or her belt, saddle or harness 19. A tear-away pack 18 is disposed between the two sections 12 and 14. Preferably, however, section 14 is helpful for facilitating attachment to the worker 17.

Section 12 consists of an elastic cord 22 surrounded by a hollow, bunched strap 20. The combination of the elastic cord 22 and strap 20 results in a lanyard 24 that is both strong and flexible. The elastic cord 22 is free to move within strap 20.

Each end of the lanyard 24 is sewed using a high strength thread 26, such as nylon or an equivalent material. It is the combination of the thread material and the stitching that results in the strength of this fastening method. However, while sewing is preferred, other fastening or adhesion means can be used to perform the same function as the thread.

The elastic cord 22 extends only partially through the strap 20. Strap 20 continues past the lanyard 24 in two directions. In one direction, strap 20 is folded and sewn onto itself, thereby creating a loop 28 which is located at the chainsaw end 30 of retaining device 10. In the other direction, strap 20 is attached to the tear-away pack 18.

Pack 18 is made of a durable material such as nylon. Affixed to pack 18 is a label 46 containing warnings and other printed information on the use and limitations of the retaining device 10. However, label 46 can be attached anywhere on device 10, as long as it does not interfere with its utility.

Loop 28 is connected to a chainsaw 15 by half hitching loop 28 directly to the chainsaw 15 or by attaching loop 28 by an intermediary mechanical device such as a carabiner, hook, clasp, or any other means known in the art. To suspend the chainsaw 15, when not in use with the worker's tree belt or harness, a ring 32 is incorporated into the structure of device 10. Even though the loop 28 may be used for attaching the retaining device 10 to a chainsaw 15, any other means of attachment can be incorporated into the structure of device 10.

Ring 32 is simply fastened to the strap 20. When strap 20 is folded over itself, the ring 32 is placed therebetween and sewn on either side with nylon thread 26. The ring 32 is retained but, at the same time, is free to move.

Section 14 consists of a second strap 34 attached to tear-away pack 18. A second ring 36 is sewn at the belt, saddle or harness end 38 of section 14. A worker 17 attaches ring 36 to his/her belt, saddle or harness 19 with a carabiner, hook, clasp, or any other mechanical means known in the art.

Figure 2:
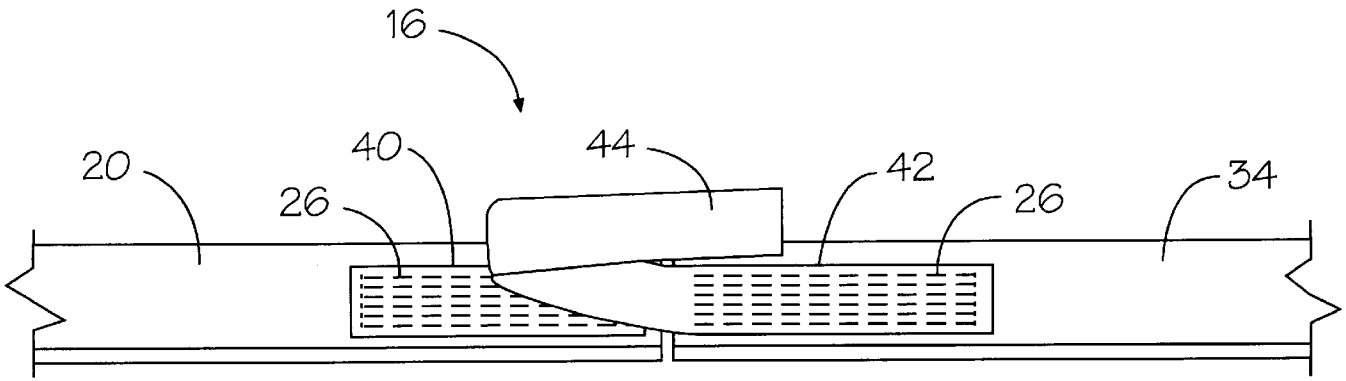
FIG. 2 shows the enlarged, perspective view of the tear-away component of the lanyard in accordance with the present invention.
Figure 3:
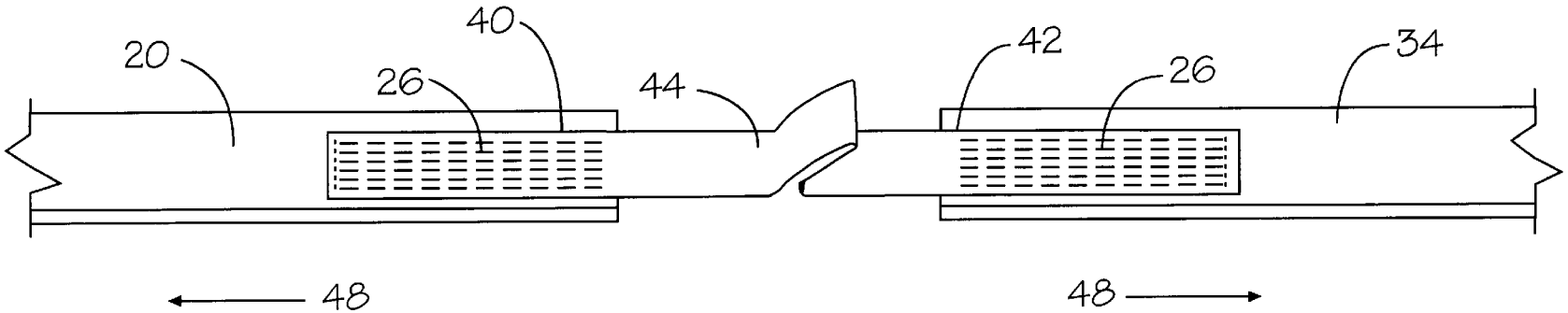
FIG. 3 depicts the tear-away component of the lanyard as it is pulled apart.

Referring now to FIGS. 2 and 3, illustrated is a tear-away component 16 enclosed within pack 18 (FIG. 1). Strap 20 is permanently attached by thread 26 to a tear-away strap 40. Similarly, second strap 34 is permanently sewn to a second tear-away strap 42. In an alternate embodiment, a worker 17 attaches second tear-away strap 42 directly to his or her belt, saddle or harness 19. The tear-away straps 40 and 42 are sewn, fastened, or attached together by some other means along a section 44.

The tear-away strap 44 slowly separates when in tension along the direction shown by arrow 48 (FIG. 3). The tension is caused by the force of a chainsaw 15 (FIG. 1) being pinched or caught by a falling tree limb. Section 44 pulls apart until both straps 40 and 42 are extended. When straps 40 and 42 pull apart, the chainsaw 15 is released from the worker 17 and falls to the ground with the limb. The worker maintains his/her position within the structure.

The slow, tear-away motion, arrow 48, minimizes the effect of the falling chainsaw 15 on a worker 17. The combination of the slow, tearing motion along with the flexibility of the lanyard 24 (FIG. 1) results in a minimal amount of force being exerted on a worker 17. The worker 17 can keep his/her footing and remain relatively stationary.

Figure 4:
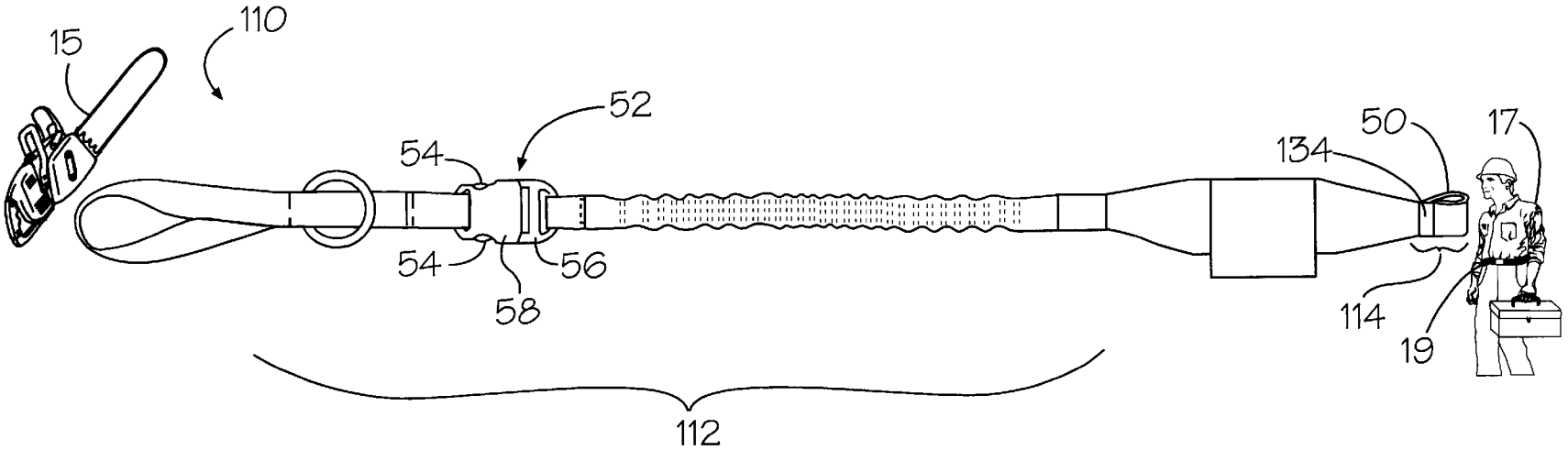
FIG. 4 illustrates an alternative embodiment of the inventive lanyard with a snap-in/out mechanism.

Referring now to FIG. 4, shown is an alternative embodiment of a retaining device 110 in accordance with the invention. The novel design incorporates a loop 50 in place of ring 36 (FIG. 1). The loop 50 is formed by folding second strap 134 onto itself.

The design can include a snap-in/out mechanism 52. A worker 17 pushes buttons 54, attached to a clip 56, which releases clip 56 from a receiver 58. This feature can be used by a worker 17 to release the chainsaw 15 from his or her belt, saddle or harness 19. It is also useful for replacing various portions of retaining device 110. The snap-in/out mechanism 52 can be located anywhere on the device 110, but preferably along section 112. Alternatively, it can be located along section 114.

Figure 5:
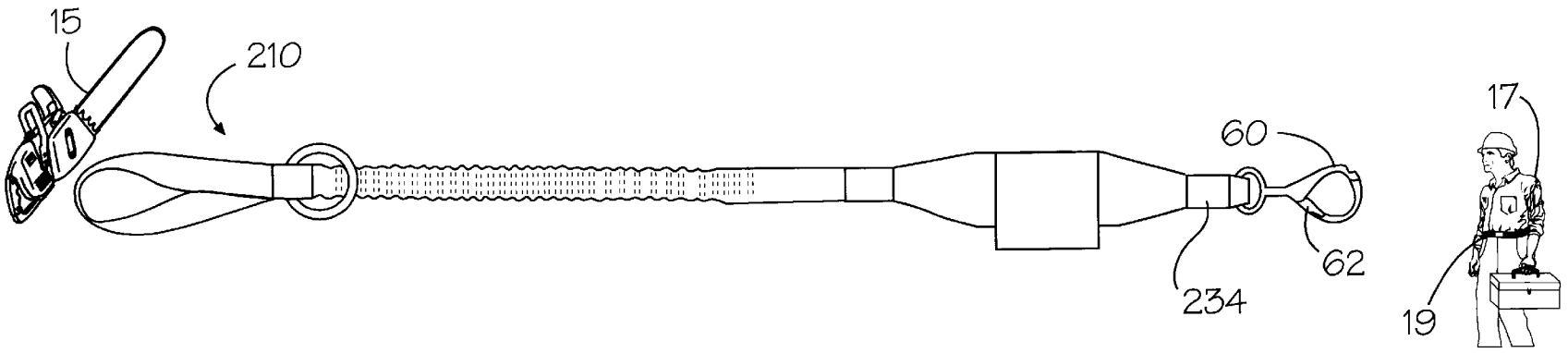
FIG. 5 illustrates another alternative embodiment of the inventive lanyard.

Referring now to FIG. 5, shown is yet another embodiment of the novel retaining device 210. Similar to FIG. 4, the structure depicted in FIG. 5 replaces ring 36 (FIG. 1) with a snap hook 60. The snap hook 60 is attached to a second strap 234 by a method well known in the art. A worker 17 can open a latch 62 and clip the snap hook 60 onto his or her belt, saddle or harness 19.

Figure 6:
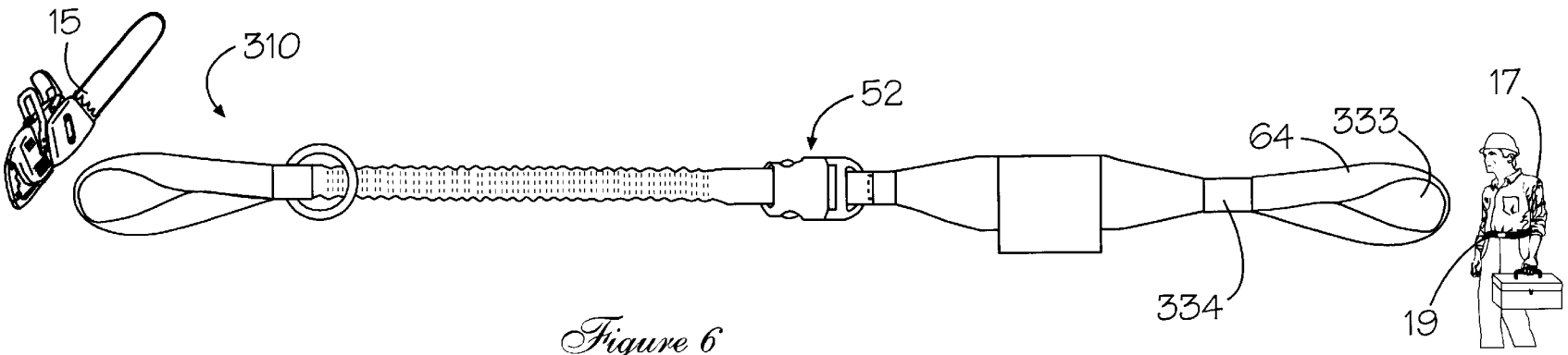
FIG. 6 shows an alternative embodiment of the inventive lanyard depicted in FIG. 4.

Referring now to FIG. 6, depicted is another embodiment of the inventive retaining device 310, in which the second strap 334 is folded and sewn onto itself, thereby creating a loop 64 located at the belt, saddle or harness end 338 of device 310. Loop 64 is connected to the worker 17, belt, saddle or harness 19 by half hitching loop 64 directly or by using an intermediary mechanical device such as a carabiner, hook, clasp, or other means known in the art. Furthermore, a snap-in/out mechanism 52 is shown in an alternative position relative to that depicted in FIG. 4.

Since other modifications and changes varied to fit particular operating requirements and environments will be apparent to those skilled in the art, the invention is not considered limited to the examples chosen for purposes of disclosure, and covers all changes and modifications which do not constitute departures from the true spirit and scope of this invention.

Having thus described the invention, what is desired to be protected by Letters Patent is present in the subsequently appended claims.

What is claimed is:

1. A retaining device for attaching a mechanical tool or apparatus to a worker, said retaining device comprising:

a first lanyard section having a distal end and a proximal end, said proximal end thereof having connection means for connecting to a worker;

a second lanyard section having a distal end and a proximal end, said distal end thereof having attachment means for attaching to a mechanical device, said second lanyard section including a stretchable component comprising an elastic cord disposed within a hollow strap and said elastic cord being free to move within said hollow strap; and a separating and tear-away component intermediate said first and second lanyard sections, one end of said separating and tear-away component being fixedly attached to said distal end of said first lanyard section and the other end of said tear-away component being fixedly attached to said proximal end of said second lanyard section, said separating and tear-away component having means to gradually separate and tear, so that, when said first and second lanyard sections are caused to separate from each other, said tear-away component minimizes the force induced on the worker, reducing the potential of injury to the worker.

2. The retaining device in accordance with claim 1, wherein said connection means comprises a first, strap fixedly attached to said distal end of said first lanyard section.

3. The retaining device in accordance with claim 2, wherein said attachment means comprises a second, strap fixedly attached to said proximal end of said second lanyard section.

4. The retaining device in accordance with claim 1, wherein said connection means comprises a ring.

5. The retaining device in accordance with claim 1, wherein said attachment means comprises a loop.

6. The retaining device in accordance with claim 1, wherein said attachment means comprises a snap.

7. The retaining device in accordance with claim 1, wherein said second lanyard section comprises a snap-in/out mechanism.

8. The retaining device in accordance with claim 1, further comprising a label attached to said retaining device.

9. A retaining device for attaching a mechanical tool or apparatus to a worker, said retaining device comprising:

a lanyard section having a distal end and a proximal end, said distal end thereof having connection means for connecting to a tool, said lanyard section including a stretchable component comprising an elastic cord disposed within a hollow strap and said elastic cord being free to move within said hollow strap; and a separating and tear-away component operatively connected to said proximal end of said lanyard section, said separating and tear away component having attachment means connected thereto for attaching said retaining device to a worker, said separating and tear-away component having means to gradually separate and tear, so that, when said worker and said at least one lanyard section are caused to separate from each other, said separating and tear-away component minimizes the shock of said separation, reducing the potential of injury to the worker.

10. The retaining device in accordance with claim 9, wherein said connecting means comprises a first strap.

11. The retaining device in accordance with claim 10, wherein said attachment means comprises a second, strap fixedly attached to said proximal end of said lanyard section.

12. The retaining device in accordance with claim 9, wherein said connection means comprises a loop.

13. The retaining device in accordance with claim 9, wherein said connection means comprises a ring.

14. The retaining device in accordance with claim 9, wherein said connection means comprises a snap.

15. The retaining device in accordance with claim 9, wherein said at least one lanyard section comprises a snap-in/out mechanism.

16. The retaining device in accordance with claim 1, wherein said tear-away component will separate under a predetermined load.

17. The retaining device in accordance with claim 9, wherein said tear-away component will separate under a predetermined load.

* * * * *